US010260699B2

(12) United States Patent
Bolander, Jr.

(10) Patent No.: US 10,260,699 B2
(45) Date of Patent: Apr. 16, 2019

(54) BI-OPTIC HEADLIGHT ASSEMBLY AND LENS OF BI-OPTIC HEADLIGHT ASSEMBLY

(71) Applicant: Grote Industries, LLC, Madison, IN (US)

(72) Inventor: Albert J. Bolander, Jr., Jeffersonville, IN (US)

(73) Assignee: Grote Industries, LLC, Madison, IN (US)

( * ) Notice: Subject to any disclaimer, the term of this patent is extended or adjusted under 35 U.S.C. 154(b) by 359 days.

(21) Appl. No.: 15/232,134

(22) Filed: Aug. 9, 2016

(65) Prior Publication Data

US 2018/0045394 A1 Feb. 15, 2018

(51) Int. Cl.

| | |
|---|---|
| ***F21S 41/19*** | (2018.01) |
| ***F21S 41/29*** | (2018.01) |
| ***F21S 41/33*** | (2018.01) |
| ***F21S 45/47*** | (2018.01) |
| ***F21S 41/143*** | (2018.01) |
| ***F21S 41/265*** | (2018.01) |
| ***F21S 41/275*** | (2018.01) |

(52) U.S. Cl.

CPC ..... *F21S 41/337* (2018.01); *F21S 41/143* (2018.01); *F21S 41/19* (2018.01); *F21S 41/265* (2018.01); *F21S 41/275* (2018.01); *F21S 41/295* (2018.01); *F21S 41/336* (2018.01); *F21S 45/47* (2018.01)

(58) Field of Classification Search

CPC ..... F21S 41/275; F21S 41/295; F21S 41/337; F21S 41/265; F21S 41/285; F21V 13/04; F21V 5/045; F21V 7/06

See application file for complete search history.

(56) References Cited

U.S. PATENT DOCUMENTS

2010/0165653 A1* 7/2010 Ookubo ..... F21V 13/02 362/539
2012/0057363 A1* 3/2012 Ishida ..... F21S 41/143 362/516
2012/0120652 A1 5/2012 Bolander, Jr. et al.

(Continued)

OTHER PUBLICATIONS

The International Search Report and Written Opinion of the International Searching Authority dated Oct. 17, 2017 in connection with the corresponding PCT international patent application No. PCT/US2017/039185.

*Primary Examiner* — William N Harris

(74) *Attorney, Agent, or Firm* — Posz Law Group, PLC

(57) ABSTRACT

A vehicle headlight for a semi-trailer truck and agricultural vehicle that includes a parabolic reflector, a light source, a lens, and lens legs that attach the lens to the parabolic reflector. The parabolic reflector includes a flat bottom, a curved sidewall that extends outwardly from the flat bottom to define an outer edge. The light source is attached to the flat bottom of the parabolic reflector. The light source emits light toward the outer edge of the parabolic reflector. A lens is located between the light source and the outer edge of the parabolic reflector. The lens includes a plurality of lens facets that are arranged in a matrix that outwardly extend toward the outer edge of the parabolic reflector. Each of the parabolic reflector and the lens have a focal point that are located at the same position on the base of the parabolic reflector.

20 Claims, 17 Drawing Sheets

(56) References Cited

U.S. PATENT DOCUMENTS

| | | | | |
|---|---|---|---|---|
| 2012/0230044 | A1* | 9/2012 | Zhang | F21K 9/69 362/487 |
| 2013/0094210 | A1* | 4/2013 | Rice | F21V 13/04 362/245 |
| 2014/0218939 | A1* | 8/2014 | Hsu | F21V 5/045 362/338 |
| 2014/0334145 | A1 | 11/2014 | Turley, Jr. et al. | |
| 2015/0146446 | A1 | 5/2015 | Barta et al. | |
| 2016/0003451 | A1* | 1/2016 | Beijer | F21V 5/002 362/308 |
| 2017/0299136 | A1* | 10/2017 | Chiu | F21S 41/143 |

* cited by examiner

BI-OPTIC HEADLIGHT ASSEMBLY AND LENS OF BI-OPTIC HEADLIGHT ASSEMBLY

TECHNICAL FIELD

The present invention relates generally to a headlight assembly for a motorized vehicle. More particularly, the present invention relates to a bi-optic headlight assembly for tractor trailers and agricultural vehicles, and a related method for producing the associated lens of the bi-optic headlight assembly.

BACKGROUND

Conventional headlights fail to efficiently capture much of the light emitted from a light source. That is, conventional headlights unnecessarily waste emitted light from a light source. For example, some conventional headlights are arranged such that the light source is pointed rearwardly so that light is emitted toward a base and subsequently reflected outwardly. However, this arrangement has a tendency to block the reflected light and decrease the overall efficiency of the headlight. This is at least because the light source of conventional rearward facing, or otherwise inward facing, headlights may include additional components (such as a heat sink) that increase the amount of blocked light as light reflects outwardly, since these components occupy space within the headlight.

Furthermore, the above mentioned light blocking issue is further compounded as headlights become smaller. For example, a conventional headlight with a given-sized light source and heat sink will block a certain percentage of reflected light. As the same conventional headlight decreases in size while the size of the light source and the heat sink remain the same, the light source and heat sink occupy a greater proportion of light, and thus block more light compared to larger headlights. Therefore, the issues associated with light blocking increase as a headlight decreases in size due to the relative sizes of the components.

While some conventional headlights may include lenses, conventional lenses are typically unable to produce the fine light patterns to form at least one of a high beam pattern, a low beam pattern, or a fog pattern. This may be due to, in part, the location of the lens and the particular shape and size of the lens itself.

For example, conventional headlights that do include a lens have light-blocking issues because the light source, the lens, and the other associated components have a tendency to interfere with each other. Interference occurs, in part, because of their relative arrangements of the components within conventional headlights.

Some conventional headlights may include cones that result in several additional, and somewhat similar, shortcomings as the above mentioned headlights. In addition to the interference issues discussed above, the cones of conventional headlights often include surfaces that are difficult to mold. These cones may also be relatively large, bulky, and heavy. Some of the cones used in conventional headlights may also include a lens attached to an outermost edge. However, these conventional lenses cannot form the three common light patterns for a headlight.

Notably, an inverse relationship exists between the size of the optical components (i.e., the components that form light patterns) and the ability to form a sharp, small light pattern. For example, both fog patterns and low beam patterns require sharp, small light patterns.

Thus, the inverse relationship limitation attributes to the excessive weight and bulkiness found in conventional lenses, as larger optical components are often presumed to be required. These conventionally perceived limitations, along with the blocking effect that occurs based on, for example, light source and heat sink placement, result in several shortcomings of conventional headlights.

SUMMARY

A vehicle headlight is provided comprising a parabolic reflector that includes a flat bottom, a curved sidewall that extends outwardly from the flat bottom to define an outer edge, and a first focal point located on the flat bottom; a light source that is attached to the flat bottom of the parabolic reflector, that has a front side that faces the outer edge of the parabolic reflector and that emits light toward the outer edge of the parabolic reflector, and a rear side that is opposite to the front side; a lens that is located between the light source and the outer edge of the parabolic reflector, that is configured to direct light emitted from the light source beyond the outer edge of the parabolic reflector to form a light pattern, that includes a second focal point located on the flat bottom of the parabolic reflector at a same position as the first focal point of the parabolic reflector, and that includes a plurality of lens facets that are arranged in a matrix that outwardly extend toward the outer edge of the parabolic reflector; and lens legs that attach the lens to the parabolic reflector.

The vehicle headlight may further comprise a circuit board that is attached to the flat bottom of the parabolic reflector and that is electrically connected to the light source, and a heat sink that is attached to the circuit board.

The vehicle headlight may further comprise a housing that encloses at least one of the parabolic reflector, the light source, the lens, and the heat sink.

The flat bottom of the parabolic reflector has a bottom diameter, and the lens has a lens diameter equal to the bottom diameter of the parabolic reflector.

The vehicle headlight according to claim 1, wherein the parabolic reflector may include a plurality of reflector facets that are arranged along the curved sidewall of the parabolic reflector.

The parabolic reflector may include attachment grooves that mate with the lens legs of the lens and that secure the lens legs to the parabolic reflector.

The lens of the vehicle headlight may be a cylindrical lens.

The lens of the vehicle headlight may be a Fresnel lens.

The lens may include a circular main body that has a center. Each of the plurality of lens facets may have a jagged angular curvature. The respective jagged angular curvatures of the plurality of lens facets may increase as a lens facet distance from the center of the lens decreases and as the lens facet distance from the curved sidewall of the parabolic reflector increases.

The lens of the vehicle headlight may have an edge sidewall, and the outer edge of the parabolic reflector and the edge sidewall of the lens may align along a diagonal line that intersects the first focal point of the parabolic reflector and the second focal point of the lens, which may both be located at the same position.

The light source of the vehicle headlight may be located at the first focal point of the parabolic reflector and the second focal point of the lens to form a low beam light pattern.

The light source may be located at a first position on the bottom plate of the parabolic reflector that is different than the first focal point and the second focal point to form a high beam light pattern.

The light source of the vehicle headlight may be located at a second position on the bottom plate of the parabolic reflector that is different than the first focal point and the second focal point to form a fog light pattern.

The parabolic reflector of the vehicle headlight may define a parabola that includes a latus rectum that extends across the parabola and a focus located on the latus rectum. The bottom plate of the parabolic reflector may attach to the curved sidewall of the parabolic reflector at a third position that corresponds to the latus rectum of the parabola, and the first focal point of the parabolic reflector may be located at a fourth position that corresponds to the focus of the parabola, which is located on the latus rectum.

The lens may further be configured to capture the light emitted from the light source in a first range of about 55-65%, and to form a spread light portion of the light pattern. The parabolic reflector may be configured to capture the light emitted from the light source in a second range of about 35-45%, which is uncaptured by the lens, and to form a blended light portion and a hot spot portion of the light pattern.

The lens may be configured to capture a first amount of the light emitted from the light source, and to form a spread light portion of the light pattern. The parabolic reflector may be configured to capture a second amount of the light emitted from the light source, which is uncaptured by the lens, and to form a blended light portion and a hot spot portion of the light pattern.

The lens may be configured to capture the first amount of light from a center spatial part of the light emitted from the light source. The parabolic reflector may be configured to capture the second amount of light from an outer spatial part of the light emitted from the light source.

The first amount of light may be about 54% of the light emitted from the light source, and the second amount of light may be about 46% of the light emitted from the light source.

A lens of the vehicle headlight is provided that comprises the following: a circular lens main body having a center; a first optical surface located on the circular lens main body; a second optical surface that is opposite to the first optical surface on the circular main body; an edge sidewall that connects the first optical surface to the second optical surface; and a plurality of facets that are arranged on the first optical surface in a matrix that outwardly extends from the first optical surface, and that each have a jagged angular curvature that points toward the center of the circular lens main body, the respective jagged angular curvatures of the plurality of lens facets increases as a lens facet distance from the center of the lens decreases and as the lens facet distance from the curved sidewall of the parabolic reflector increases.

The plurality of facets of the lens may be arranged in rows and columns, and the plurality of facets may include a center column that is rounded and that extends outwardly from the first surface of the circular lens main body.

A method for manufacturing a lens is provided that comprises the following: providing a lens that has a curved surface, a bottom surface opposite to the curved surface, an edge sidewall that connects the curved surface to the bottom surface, and a center located on a longitudinal axis of the cylindrical lens; slicing the curved surface of the cylindrical lens into a plurality of columns in which a depth of each of the plurality of columns extends to the edge sidewall of the cylindrical lens; slicing the curved surface of the cylindrical lens into a plurality of rows in a direction perpendicular to the plurality of columns to form a plurality of lens facets arranged in a matrix; and forming each of the plurality of lens facets with a jagged angular curvature such that the respective jagged angular curvatures of the plurality of lens facets increases as a lens facet distance from the center of the lens decreases and as the lens facet distance from the edge sidewall of the parabolic reflector increases, and such that the respective jagged angular curvatures of the plurality of lens facets point to the center of cylindrical lens.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the disclosed embodiments.

DETAILED DESCRIPTION

The present disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The use of subheadings in the present disclosure should not be construed as limiting the description of those features to the discussion within a particular subheading. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. Likewise, the use of positional terms such as front, back, side, top, and bottom are used solely to provide a reference point for one particular orientation, and to enhance clarity. Their use does not imply that such an orientation is required.

Overview

The bi-optic headlight 20 of the disclosed embodiments is entitled "bi-optic" because the bi-optic headlight 20 includes two optical components. Optical components produce the light patterns of a headlight. In particular, the two optical components of the bi-optic headlight 20 are configured to work together in order to form a single light pattern, in contrast to providing only a single optical component that forms a light pattern by itself.

For example, the bi-optic headlight 20 includes a first optical component and a second optical component. Each of the first optical component and the second optical component direct different portions of emitted light from a light source 40 in order to form a single light pattern. Thus, the two optical components of the disclosed bi-optic headlight have an interdependence that aides in the bi-optic headlight's efficient light capture of light emitted from a light source 40.

Unexpectedly, the two optical components result in a greater light efficiency than the two optical opponents would individually achieve. This increased efficiency is due to, in part, a synergistic effect between the two optical components.

Figure 1:
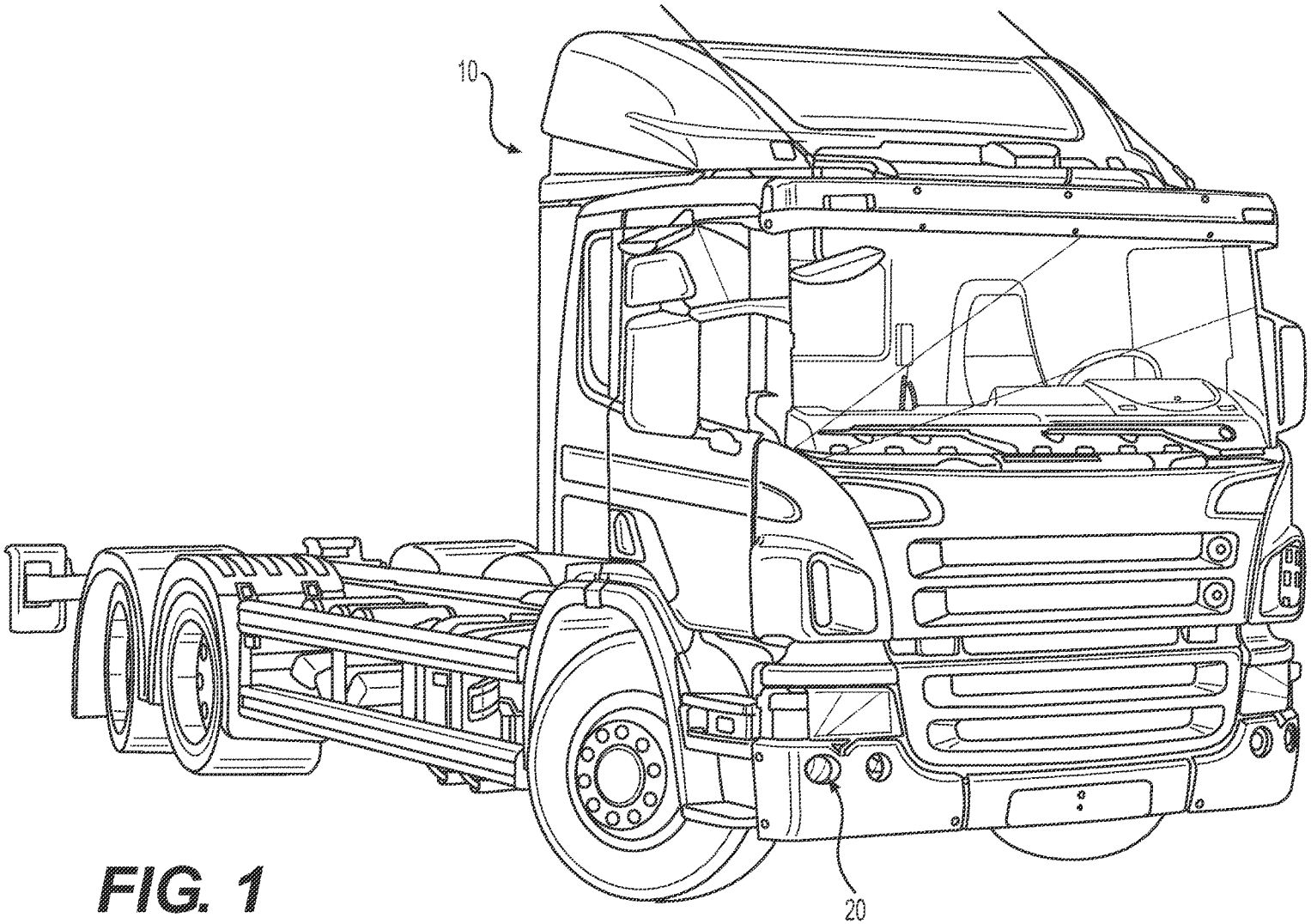
FIG. 1 is a perspective view of a semi-trailer truck that includes a bi-optic headlight, according to the disclosed embodiments, located on the lower bumper.

The applicability of the bi-optic headlight 20 of the disclosed embodiments is widespread. Examples of vehicles that may use the bi-optic headlight 20 includes, but is not limited to, agricultural vehicles and industrial vehicles. For example, a common industrial vehicle that may implement the bi-optic headlight 20 of the present disclosure is a semi-trailer truck 10. FIG. 1 is an exemplary view of a semi-trailer truck 10, without an attached semi-trailer, that includes the bi-optic headlight 20 of the disclosed embodiments.

Specifically, the bi-optic headlight 20 is located in a small hole in the lower bumper of the semi-trailer truck 10. The bi-optic headlight 20 may be a 90 mm headlight as shown in FIG. 1, although the disclosed embodiments are not limited thereto.

Although FIG. 1 shows a semi-trailer truck 10 with a single pair of bi-optic headlights 20 of the present disclosure, the bi-optic headlight 20 is not limited to being implemented only once as a single pair of headlights or being implemented in a semi-trailer truck 10. The bi-optic headlight 20 of the present disclosure is much more widely adaptable. For example, an agricultural vehicle could include three pairs of the bi-optic headlights 20. Each of the three bi-optic headlights 20 in an agricultural vehicle, for example, could be configured such that they each produce a different light pattern (such as a high beam, a low beam, and a fog beam).

Figure 2:
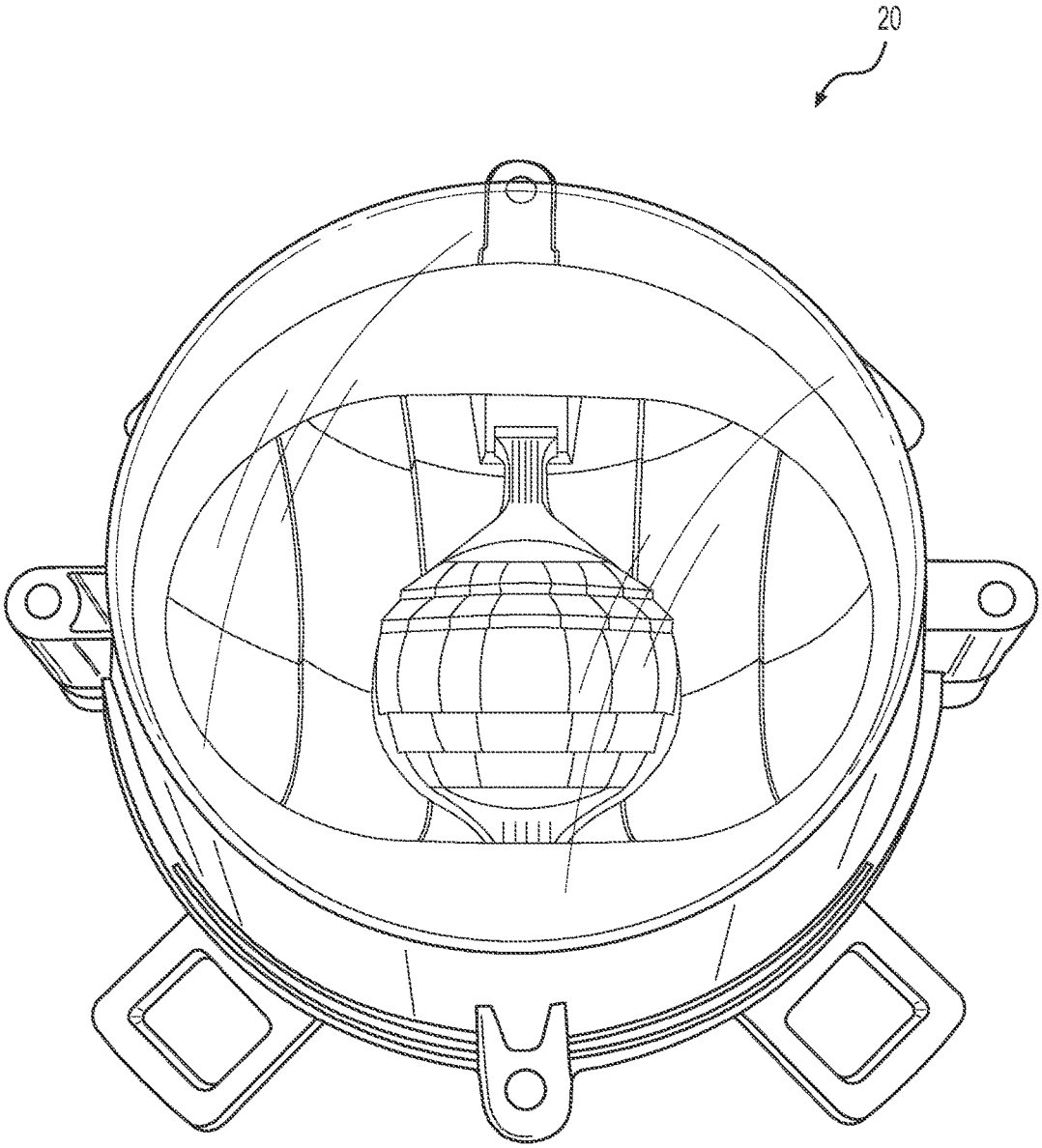
FIG. 2 is a perspective, top view of the bi-optic headlight, according to the disclosed embodiments.

A closer view of the bi-optic headlight 20 installed in the lower bumper of the semi-trailer truck 10 can be seen in FIG. 2. FIG. 2 provides a perspective overview of the bi-optic headlight 20.

Components of the Bi-Optic Headlight

Figure 3:
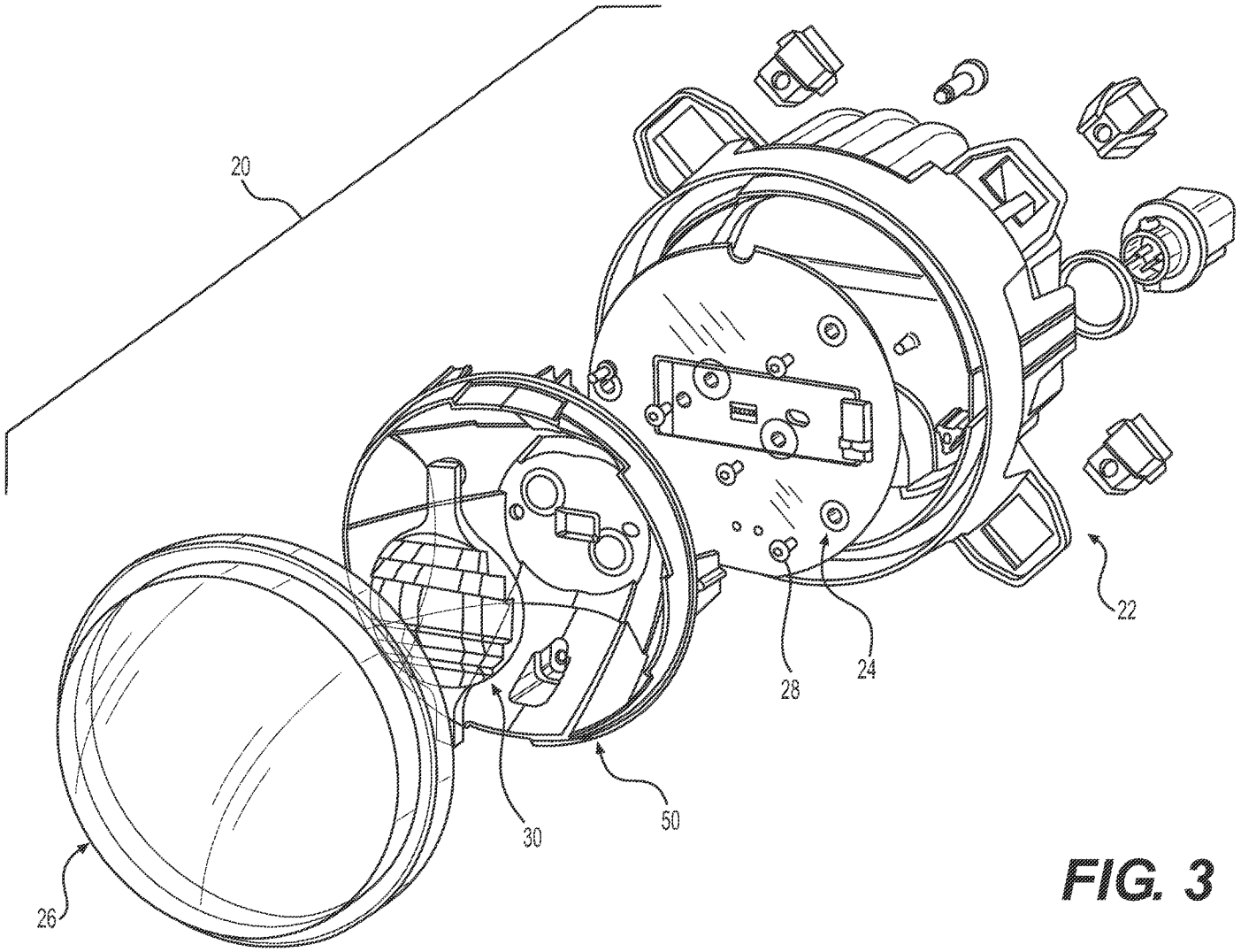
FIG. 3 is an exploded, perspective view of the bi-optic headlight, according to the disclosed embodiments.

As mentioned above, the bi-optic headlight 20 includes two optical components, which work together in order to form a common light pattern. In general, the bi-optic headlight 20 includes a lens 30 and a parabolic reflector 50 that correspond to the two optical components. The lens 30 and the parabolic reflector 50 can be seen in FIG. 3. FIG. 3 is an exploded, perspective view that shows the components of the bi-optic headlight 20. Similarly, FIG. 4 is an exploded, perspective view of the bi-optic headlight 20 that shows various cross-sections of the bi-optic headlight 20.

As shown in FIG. 3, the bi-optic headlight 20 may include an outer lens housing 26, a lens 30, a parabolic reflector 50, a circuit board 24, and a housing 22. The bi-optic headlight 20 may also include a light source 40 and a heat sink 42, as shown in FIG. 4. Although the lens 30 shown in FIGS. 2, 3, and 4 is attached in a relative vertical orientation, the lens 30 may also be attached in a different orientation, such as a horizontal orientation, or in any orientation required by specific headlight specifications.

The light source 40 may be, in some embodiments, a light emitting diode ("LED") or an array of LEDs. In other embodiments, the light source 40 may be a filament-based bulb or a gas-based bulb.

Figure 4:
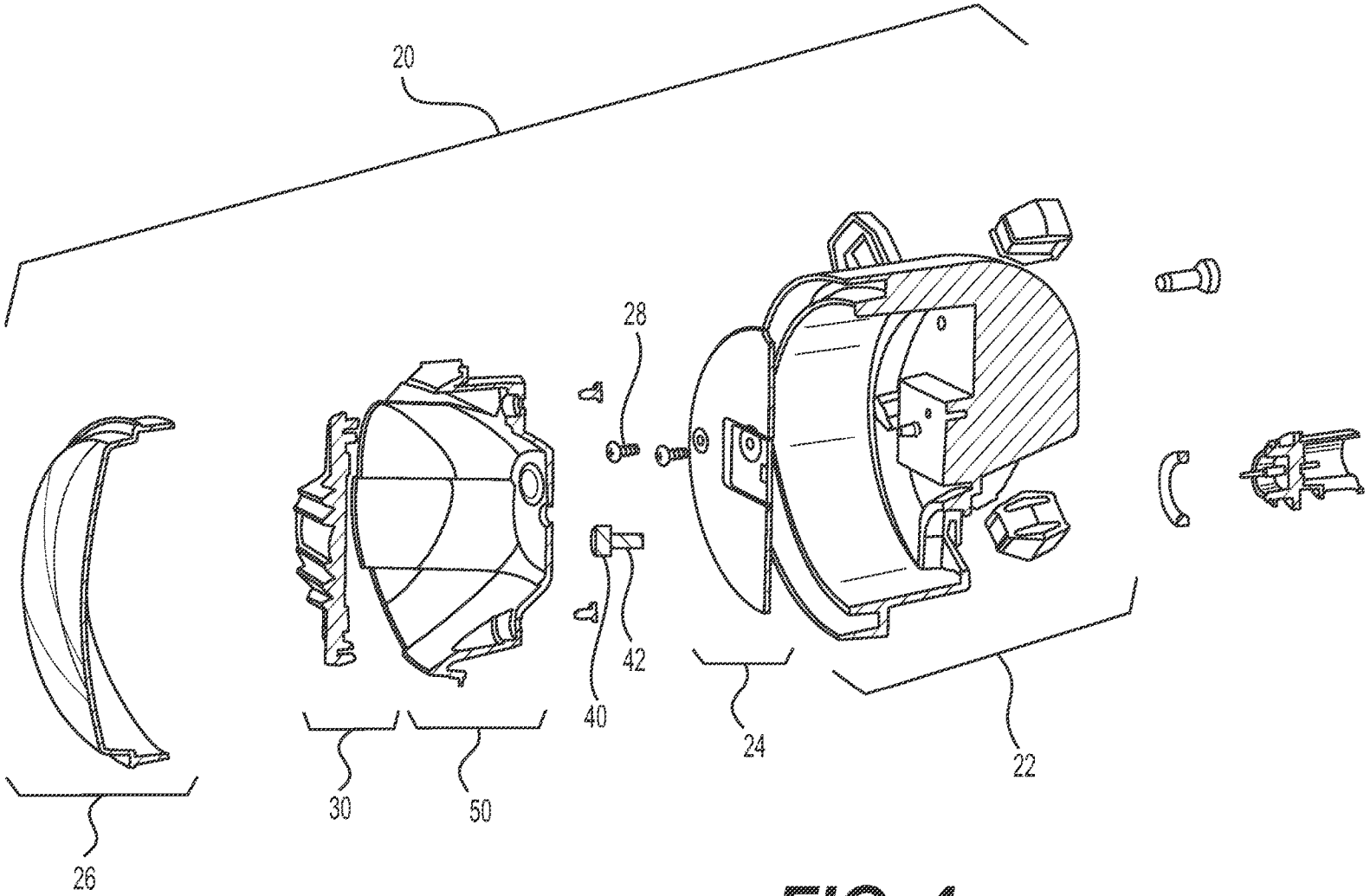
FIG. 4 is an exploded, perspective view of the bi-optic headlight that shows various cross-sections of the bi-optic headlight, according to the disclosed embodiments.

As shown in FIGS. 3 and 4, the bi-optic headlight 20 may include at least one fastener 28 in order to assemble the bi-optic headlight 20. FIGS. 3 and 4 show a plurality of fasteners 28 in order to secure the lens 30 to the parabolic reflector 50, the circuit board 24 to the parabolic reflector 50, and housing 22 together.

Lens

The lens 30 includes a plurality of lens facets 32. The plurality of lens facets 32 can be seen in FIGS. 4 and 5. The plurality of the lens facets 32 allow the lens 30 to direct light in order to form a portion of a particular light pattern. Each of the plurality of lens facets 32 extend from a side of the lens 30 that is opposite to the base 58 of the parabolic reflector 50. The other side of the lens 30 that faces the base 58 may be flat or curved.

The plurality of lens facets 32 allow the lens 30 to operate as a Fresnel lens. With the plurality of lens facets 32, the lens 30 can be thinner than conventional lenses (such as cylindrical lenses). Although a Fresnel lens may conventionally include a circular pattern, the lens 30 of the disclosed embodiments has a matrix shape, in some disclosed embodiments.

For example, the plurality of lens facets 32 are arranged in columns and rows such that the plurality of lens facets 32 form a matrix. The columns and rows of the plurality of lens facets 32 are perpendicular to each other. The columns and rows of the plurality of lens facets 32 may be spaced at equal distances apart. Alternatively, only some of the rows and/or columns may be equally spaced apart at a particular interval while other rows and/or columns are spaced apart at a different interval. The center of the lens 30 may also include a curved section located at the center of the matrix.

Figure 5:
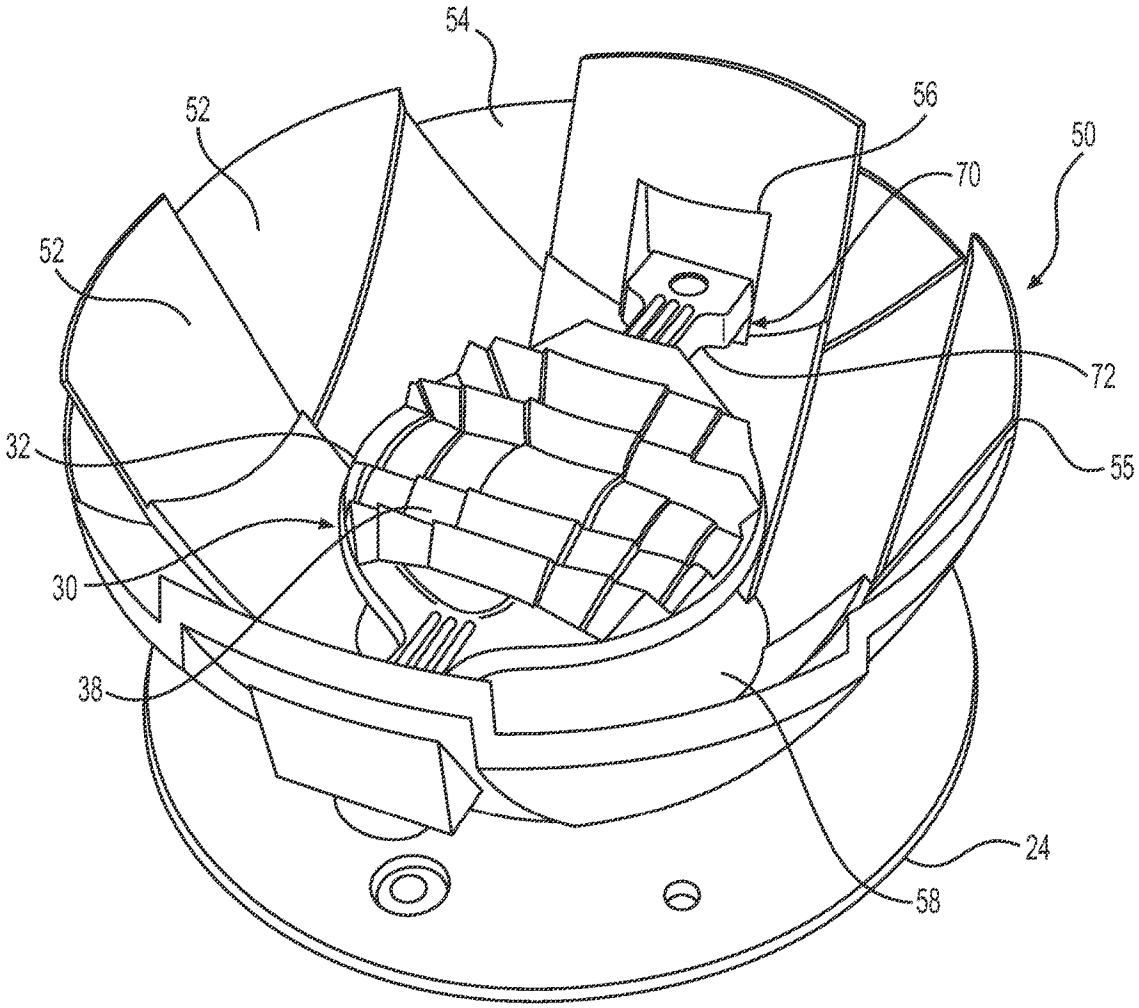
FIG. 5 is a perspective view of the bi-optic headlight with a closer view of the associated lens and reflector.

As seen in FIGS. 4 and 5, the plurality of lens facets 32 outwardly extend from the lens 30, and slightly curve inward toward the center of the lens 30. That is, each of the plurality of lens facets 32 outwardly extend to form a plurality of jagged angular curvatures 38. The profile of each of the jagged angular curvatures 38 can notably be seen in the cross-sectional view shown in FIG. 4.

The angle of each of the jagged angular curvatures 38 increases with respect to the vertical direction corresponds to the proximity of each of the plurality of lens facets 32 to the center of the lens 30. In other words, with respect to the parabolic reflector 50, an interior angle of each of the jagged angular curvatures 38 increases as each of the plurality of lens facets 32 is both (1) located farther away from the curved sidewall 54 of the parabolic reflector 50 and (2) is located closer to a center portion of the lens 30. Each of the jagged angular curvatures 38 point to the center of the lens 30, in some embodiments.

For example, a first interior angle located closest to the center portion of the lens is greater than a second adjacent interior angle located farther away from the center portion, with respect to the vertical direction. Therefore, each of the respective interior angles of the jagged angular curvatures increases (with respect to the vertical direction) as each of the respective interior angles is located closer to the center portion of the lens 30. Note that as the interior angle of each jagged angular curvature increase with respect to the vertical direction, the respective curvature of each jagged angular curvature increases as well.

The lens 30 may also include a support structure, such as lens legs 70. As shown in FIG. 5, the lens legs 70 extend from the lens 30 and attach to the parabolic reflector 50. The lens legs 70 may attach the lens 30 to the parabolic reflector 50 in any orientation, such as a horizontal orientation as shown in FIG. 5. Although the lens legs 70 in FIG. 5 are shown to outwardly extend and attach to the parabolic reflector 50, other embodiments of the lens legs 70 may connect to a different portion of the bi-optic headlight 20. The lens legs 70 will be discussed in greater detail further below.

Parabolic Reflector

As shown in FIG. 5, the parabolic reflector 50 includes a base 58 and a curved sidewall 54 that extends from the base to define an outer edge 55. The outer edge 55 of the parabolic reflector 50 defines the opening of the bi-optic headlight 20. Although the outer edge 55 of the parabolic reflector 50 is staggered in FIG. 5, the outer edge 55 may be a continuously flat outer edge in some embodiments. In addition, the outer edge 55 may be an outer circumferential edge of the parabolic reflector 55. The base 58 is located at one edge of the curved sidewall 54, and the other end of the curved sidewall 58 opens to form an outer edge 55.

The curved sidewall 54 of the parabolic reflector 54 includes a plurality of reflector facets 52, as shown in FIG. 5. The plurality of reflector facets 52 are each aligned along at least the interior of the curved sidewall 54 of the parabolic reflector 50. That is, each of the plurality of reflector facets 52 are curved to mate with the curved sidewall 54 of the parabolic reflector 50. In some embodiments, the plurality of reflector facets 52 are etched into the curved sidewall 54. Whereas, in other embodiments, the plurality of reflector facets 52 are separately attached to the curved sidewall 54. The plurality of reflector facets 52 direct light analogous to the manner in which the plurality of lens facets 32 direct light.

The parabolic reflector 50 may also include attachment grooves 56. Attachment grooves 56 may be located on opposite sides of the curved sidewall 54 of the parabolic reflector 50. The attachment grooves 56 are configured to mate with a support structure of the lens 30, such as the lens legs 70. Although FIG. 5 only shows two attachment grooves 58, the bi-optic headlight 20 may include a fewer or greater number of attach grooves 56.

The base 58 of the parabolic reflector 50 is circular. The shape of the base 58 of the parabolic reflector 50 is shaped in a manner similar to the lens 30. Indeed, the base 58 of the parabolic reflector 50 has a base diameter 64 that is equal to the lens diameter 34, as shown in FIG. 6 and as discussed in greater detail below.

Relationship Between the Lens and the Parabolic Reflector

Figure 6:
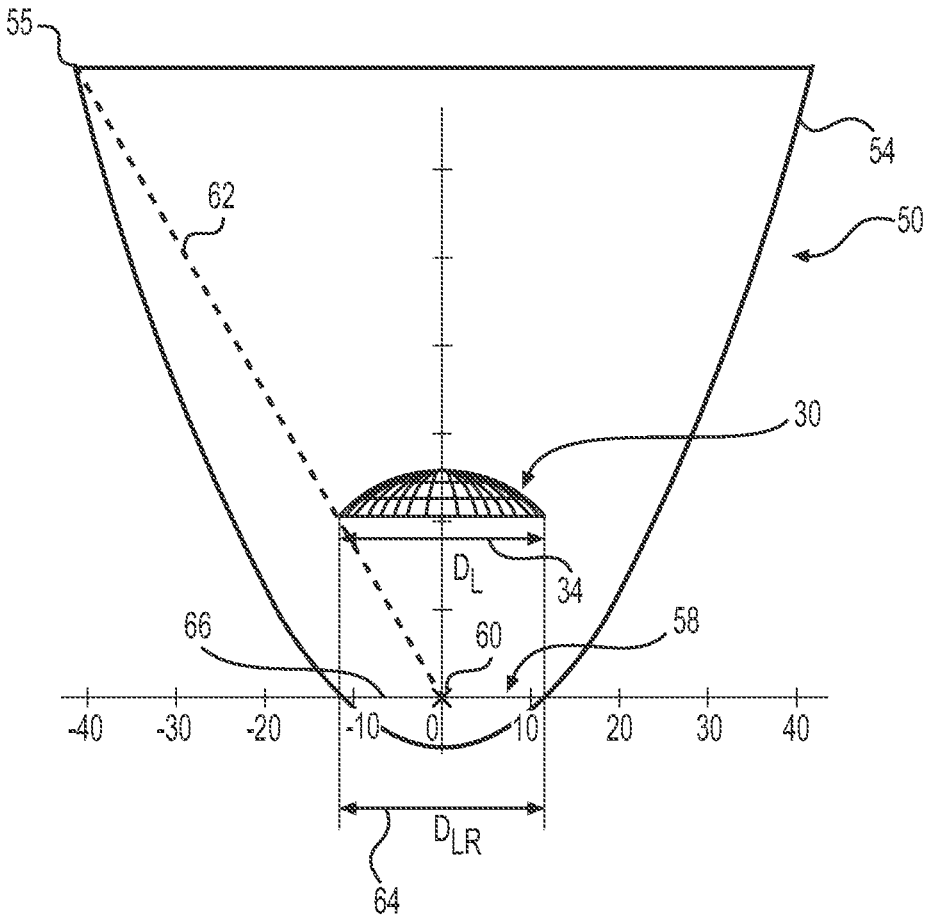
FIG. 6 is a sectional view of the bi-optic headlight mapped onto a coordinate system to show the spatial relationships between the components of the bi-optic headlight, according to the disclosed embodiments.

FIG. 6 is a cross-sectional view of the bi-optic headlight 20 that shows the spatial relationship between the parabolic reflector 50 and the lens 30. In order to show the spatial relationship between the lens 30 and the parabolic reflector 50, FIG. 6 provides the two optical components (i.e., the parabolic reflector 50 and the lens 30) on a coordinate system with vertical and horizontal axes (i.e., an x-and-y coordinate system).

As shown in FIG. 6, the parabolic reflector is shaped like a parabola when viewed in two-dimensions. Note that in three-dimensions, the parabolic reflector is shaped as a paraboloid, but the present discussion will refer to the shape of the parabolic reflector 50 as a parabola, as these dimensions aid in the understanding of this feature.

As shown in FIG. 6, the base 54 of the parabolic reflector 50 spans across a chord of the parabola. In particular, the base 54 is located at the latus rectum 66 of the parabolic reflector 50. The latus rectum 66 is the shortest chord (i.e., line) that intersects the focus of a parabola and that connects to each side of the curved sidewall 54 of the parabolic reflector 50. The latus rectum is also defined as running parallel to the directrix of a parabola.

For example, the parabolic reflector 50 may be shaped as a short focal length parabola that a base diameter 64 (i.e., a latus rectum 66 distance) equal to the lens diameter 34. Indeed, since the base 58 extends across the latus rectum 66, the base 58 of the parabolic reflector 50 has a bottom diameter 64 equal to the distance of the latus rectum 66. Therefore, the base diameter 64, the distance of the latus rectum 66, and the lens diameter 34 of the bi-optic headlight 20 are all equal to each other.

With the above noted configuration, the lens 30 can form a portion of the three basic light patterns (i.e., high beam, low beam, and fog beam). That is, the lens 30 can capture a first part (e.g., a center spatial part) of the light emitted from the light source 40, and direct the emitted light to form a portion of a basic light pattern. On the other hand, the parabolic reflector 50 is configured and arranged to capture a second part (e.g., an outer spatial part) of the emitted light, and to form a second portion of the same light pattern.

The above configuration allows the bi-optic headlight 20 to form different light patterns based on different locations of the light source 40 relative to a common focus 60 of the lens 30 and the parabolic reflector 50. The particular location of the light source 40 relative to the focus of the lens 30 and the parabolic reflector 50 will be discussed in greater detail further below in reference to FIGS. 9A-9I.

Generally, the two optical components (i.e., the lens 30 and the parabolic reflector 50) of the bi-optic headlight 20 do not interfere with each other, but instead work together such that as one component stops intercepting light, the other component starts intercepting light. In other words, the lens 30 and the parabolic reflector 50 may collect light from different regions of the angular emission profile of the light source located at the focus.

For example, the lens 30 may capture a center spatial part of the light emitted from the light source 40. On the other hand, the parabolic reflector 50 may capture an outer spatial part of the light emitted from the light source 40. In order to capture these different portions of the light emission profile of the light source 40, the lens 30 and the parabolic reflector 50 are arranged at particular positions and shaped to include particular relative dimensions, as shown in FIG. 6 and discussed below.

Notably, the bottom diameter 64 of the parabolic reflector 50 (which is equal to the latus rectum 66) ($D_{LR}$) and the lens diameter 34 ($D_L$), as shown in FIG. 6, are equal to each other. Similarly, the lens 30 and the parabolic reflector 50 share a common focus 60, as shown in FIG. 6. The common focus 60 of both the lens 30 and parabolic reflector 50 aligns with a diagonal line 62 that extends from the focus 60 through a peripheral edge 36 of the lens 30 to the outer edge 55 of the parabolic reflector. In other words, the diagonal line 62 extends to connect the common focus 60 to the outer edge 55 of the parabolic reflector 50 such that an angle between the horizontal axis shown in FIG. 6 and the diagonal line 62 is the same for both the lens 30 and the parabolic reflector 50.

Due to the above described synergistic interdependent-relationship, the bi-optic headlight 20 will capture a large amount of light emitted from the light source (40) (i.e., the emission profile of the light source 40) in comparison to conventional devices.

For example, the lens 30 may capture 55-65% of the light emitted from the light source 40, and the parabolic reflector 50 may collect 35-45% of the light emitted from the light source 40 uncaptured by the lens 30. As an additional example, the lens 30 may collect about 54% of the light emitted from the light source 40, and the parabolic reflector 50 may collect about 46% of the light emitted from the light source 40. Of the total amount of captured light emitted from the light source 40, a certain percentage (such as 30%) may be lost in transmission through the lens 30, reflection off the parabolic reflector 50, and/or scattering off imperfect optical surfaces.

Mathematical Explanation of the Relationship Between the Lens and the Parabolic Reflector The following mathematical description summarizes, and further explains, the above noted interdependence of the two optical components (i.e., the lens 30 and the parabolic reflector 50).

The focal length of a lens 30 is the distance between a lens 30 and its focus. In general, the focal length of a lens 30 can be found using the Lens Maker's Equation, as listed below in Equation 1.

$$\frac{1}{f} = (n-1)\left[\frac{1}{R1} - \frac{1}{R2} + \frac{(n-1)d}{nR1N2}\right] \quad \text{[EQUATION 1]}$$

In the Lens Maker's Equation (i.e., Equation 1), "f" represents the focal length of the lens 30, and "n" represents the refractive index of the lens 30. Further, "R1" represents the radius of curvature of the lens surface closest to the light source 40, "R2" represents the radius of curvature of the lens surface farthest from the light source 40, and "d" represents the thickness of the lens 30 (i.e., the distance between the two lens surfaces, R1 and R2).

Using a plano-convex lens, the lens surface farthest from the light source 40 will be flat, and thus have a zero curvature. Knowing that the radius of curvature is the inverse of curvature, this results in R2 being equal to infinity (i.e., R2=∞), and the reciprocal of R2 will thus equal zero. Assuming the refractive index is 1.5, these noted substitutions result in Equation 2 below.

$$\frac{1}{f} = 0.5\frac{1}{R_1} \quad \text{[EQUATION 2]}$$

The reciprocal of Equation 2 results in Equation 3 below.

$$f_1 = 2R_1 \quad \text{[EQUATION 3]}$$

Thus, Equation 3 shows that the focal length of the lens ($F_L$) is based on the radius of curvature of the lens surface closest to the light source (i.e., $R_1$).

The bi-optic headlight 20 of the disclosed embodiments also includes a parabolic reflector 50 with dimensions related to the dimensions of the lens 30. Therefore, a similar analysis can be used to determine the focal length of the parabolic reflector 50 with respect to the dimension of the lens 30, as understood by one skilled in the art.

As mentioned above and shown in FIG. 6, a cross-section of the parabolic reflector 50 in a two-dimensional coordinate system resembles a parabola. Using the standard equation for a parabola with a vertical axis of symmetry, the focal length of a parabola ($F_P$) on an x-y coordinate system can be found with Equation 4 below.

$$fp = \frac{x^2}{4y} \quad \text{[EQUATION 4]}$$

In the bi-optic headlight 20, the vertical component (i.e., y) of Equation 4 may be related to the horizontal component (i.e., x) by the relationship of y=2x. This substitution results in Equation 5 below.

$$fp = \frac{x}{8} \quad \text{[EQUATION 5]}$$

The horizontal component (i.e., x) of Equation 5 can be interpreted as the opening size of the parabolic reflector 50 ("Wp"). The opening size of the parabolic reflector 50 is the distance between the two opposite points on the outer edge 55 of the parabolic reflector 50.

Moreover, in the bi-optic headlight 20, the focal length of the parabola may be set as one-fourth the size of the latus rectum 66. As mentioned above, the diameter of the lens 34 ($D_L$) is equal to the distance of the latus rectum 66 as a part of the interrelationship between the components in the bi-optic headlight 20.

The relationship of these features as combined results in the in Equation 6.

$$fp = \frac{D_{lr}}{4} = \frac{f_l}{4} = \frac{R_1}{2} = \frac{Wp}{8} \quad \text{[EQUATION 6]}$$

The relationship shown in Equation 6 thus explains that the bi-optic headlight 20 may include a focal length of the parabola ($F_P$) that is equal to one-fourth the distance of both the latus rectum (66) ($D_{LR}$) and the focal length of the lens ($F_L$). The focal length of the parabola ($F_P$) of the bi-optic headlight 20 may also be equal to one-eighth the opening size of the parabolic reflector 50 (Wp). The relationship shown in Equation 6 is also based on, and a result of, the parabolic reflector 50 and the lens 30 sharing a common focus 60.

Attachment of the Lens to the Parabolic Reflector

As mentioned above in reference to FIG. 5, the lens legs 70 attach the lens 30 to the parabolic reflector 50. In FIG. 5, the lens legs 70 connect to attachment grooves 56 within the curved sidewall 54 of the parabolic reflector 50. In other embodiments, the lens legs 30 may attach directly to the curved sidewall 54 of the parabolic reflector.

Figure 7:
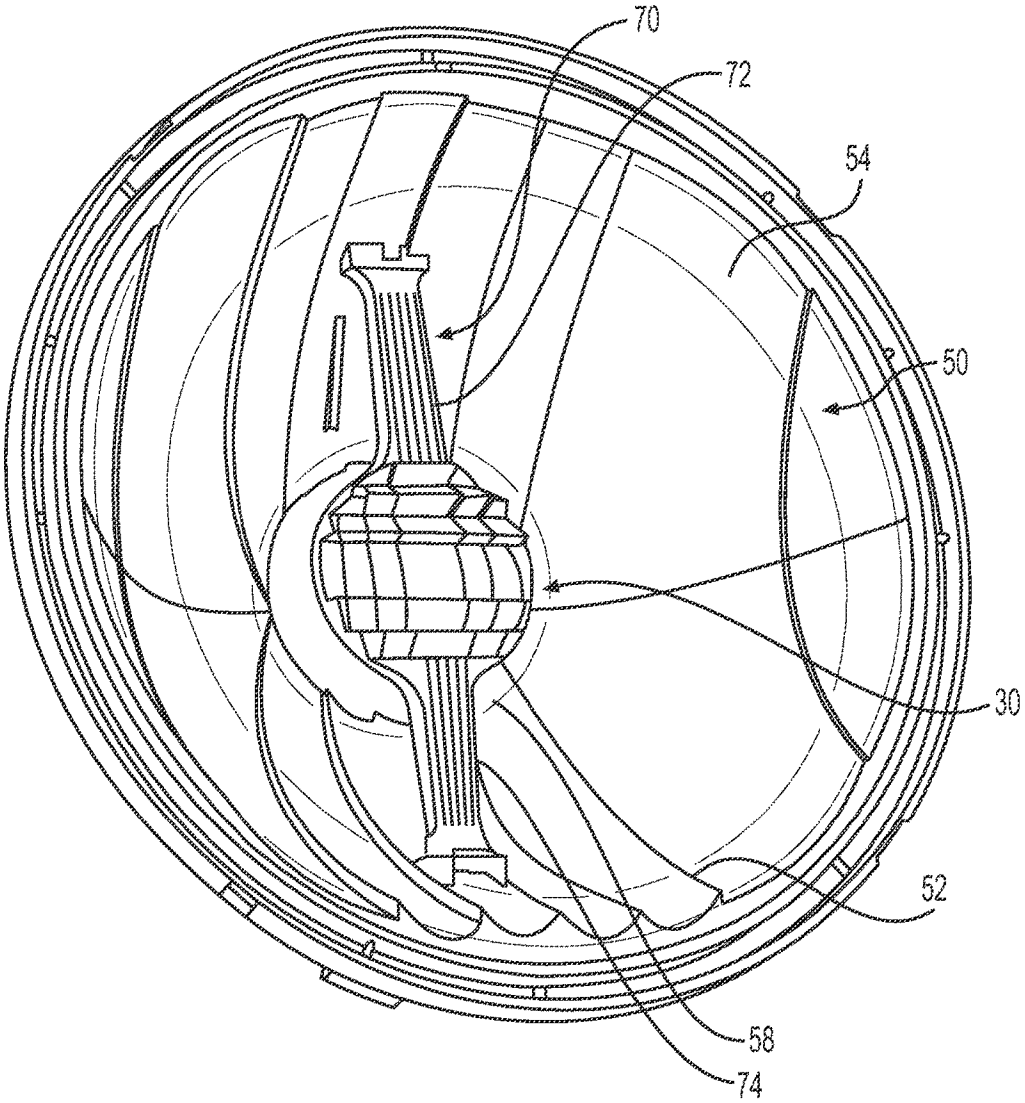
FIG. 7 is a perspective view of the bi-optic headlight that shows the legs of the lens attached to the sidewall of the reflector, according to the disclosed embodiments.

For example, FIG. 7 is a perspective view of lens legs 70 that directly connect to the curved sidewall 54 of the parabolic reflector 50. As shown in FIG. 7, the lens legs 70 outwardly extend, and mate with (or otherwise interlock with) the curved sidewall 54 of the parabolic reflector 50. The lens legs 70 may also include a first lens leg 72 and a second lens leg 74. Both the first lens leg 72 and the second lens leg 74 outwardly extend, and attach to, the curved sidewall 54.

FIG. 7 shows that the first leg 72 and the second leg 74 extend in directly opposite directions. However, the lens legs 70 may extend in different directions other than that shown in FIG. 7.

Figure 8:
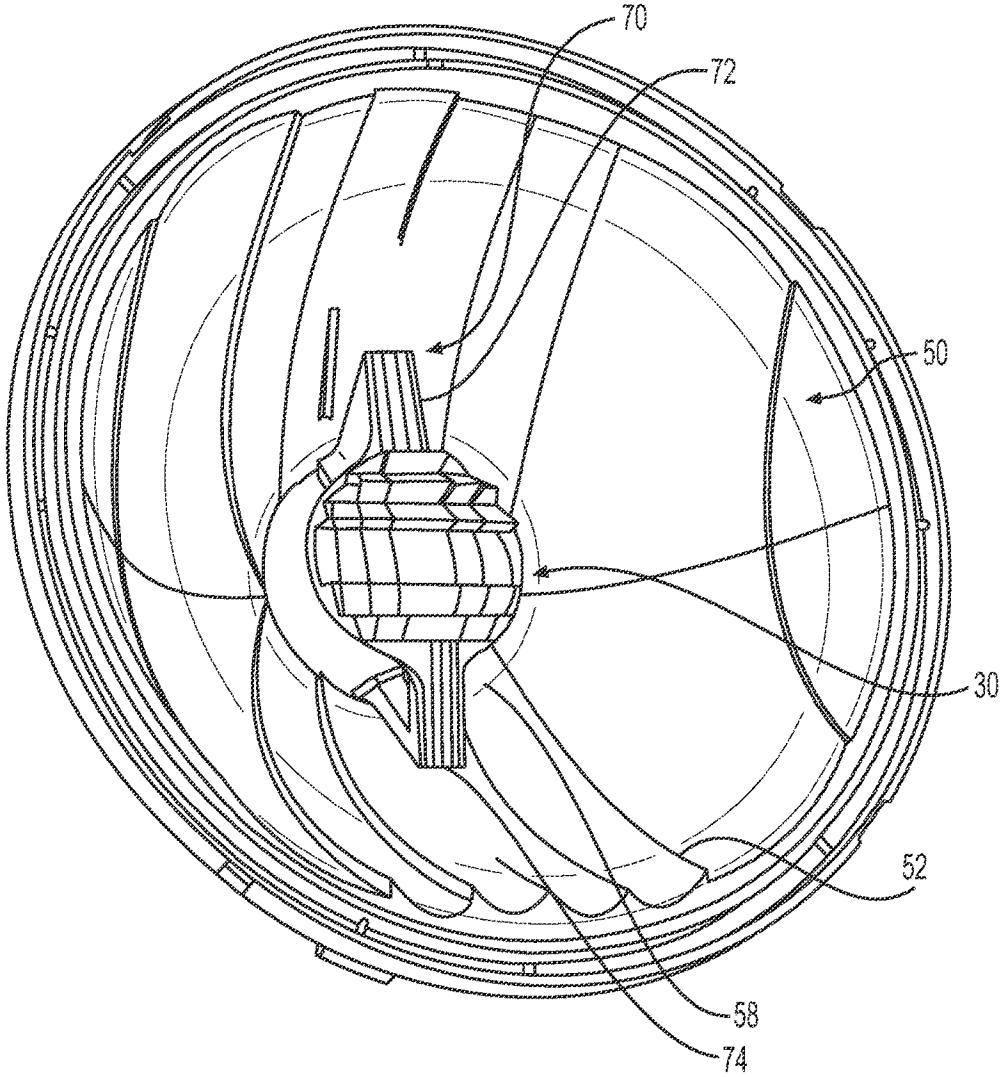
FIG. 8 is a perspective view of the bi-optic headlight that shows the legs of the lens attached to the base of the reflector, according to the disclosed embodiments.

For example, in some embodiments, the lens legs 70 do not attach to the curved sidewall 54 of the parabolic reflector 50. Instead, for example, the lens legs 70 may attach to the base 58 of the parabolic reflector, as shown in FIG. 8. FIG. 8 is a perspective view of the bi-optic headlight in which the lens legs 70 attach to the base 58 of the parabolic reflector 50.

Alternatively, the lens 70 could be a plurality of thin legs (or support structures) that each extend out from behind the base 58 of the parabolic reflector 50 to hold the lens 30 in the particular arrangement as shown in FIG. 6. In addition, although the lens 30 is shown in FIGS. 7 and 8 as being attached in a vertical orientation, the lens legs 70 may attach the lens 30 in a different orientation, such as a horizontal orientation.

Note that the lens legs 70 may be integrally formed with the lens 30, and thus made of the same material as the lens 30, as shown in FIGS. 7 and 8. Alternatively, the lens legs 30 may be made from a different materially and separately attached to the lens 30.

Although the two optical components (i.e., the lens 30 and the parabolic reflector 50) efficiently capture the light emitted from the light source 40, the lens legs 70 may affect the efficiency of the bi-optic headlight 20. Thus, the lens legs 70 may be configured in order to reduce the negative effects, if any, that the lens legs 70 may have on the efficiency of the bi-optic headlight 20.

Formation of Light Patterns

As mentioned above, the bi-optic headlight 20 can be configured to produce the three standard headlight beam patterns. Namely, the three standard headlight beam patterns include low beam, high beam, and fog beam. To do so, the light source 40 can be installed at three different positions relative to the common focus 60 of the lens 30 and the parabolic reflector 50. As mentioned above, although the lens 30 and the parabolic reflector 50 each include a focal point, their respective focal points (i.e., foci) are alighted together to form the common focus 60 in the bi-optic headlight 20. This allows the two optical components to synergistically work together to efficiently form a single light pattern.

Figure 9A:
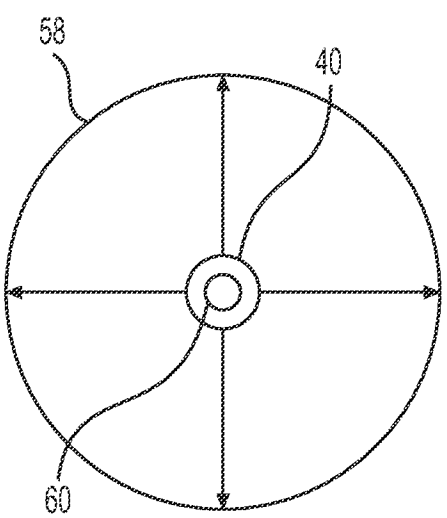
FIG. 9A is a top, plan view of a low beam pattern arrangement of the bi-optic headlight, which shows the light source relative to the combined focus of both the reflector and the lens, according to the disclosed embodiments.
Figure 9B:
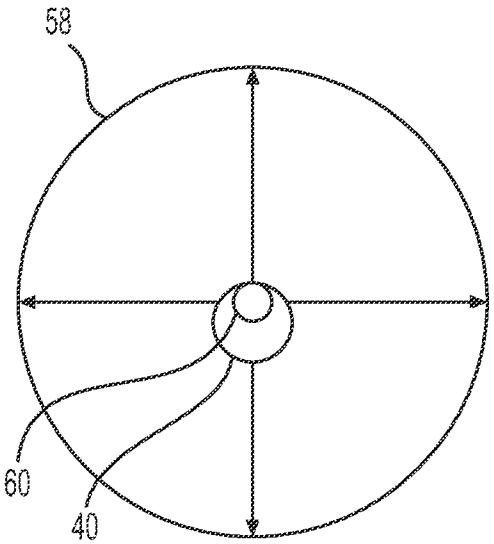
FIG. 9B is a top, plan view of a high beam pattern arrangement of the bi-optic headlight, which shows the light source relative to the combined focus of both the reflector and the lens, according to the disclosed embodiments.
Figure 9C:
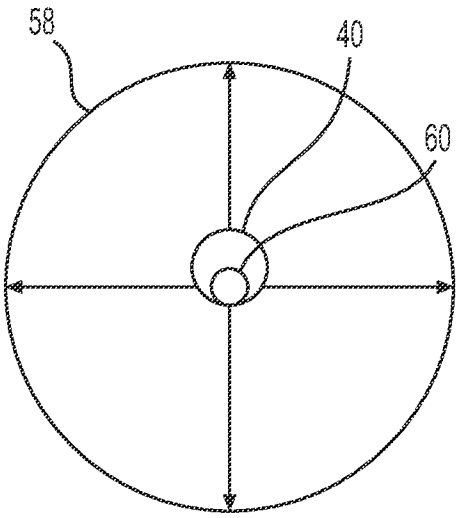
FIG. 9C is a top, plan view of a fog beam pattern arrangement of the bi-optic headlight, which shows the light source relative to the combined focus of both the reflector and the lens, according to the disclosed embodiments.

FIGS. 9A-9I show different aspects related to the formation of the three common beam patterns formed when the light source 40 is installed at different positions relative to the common focus 60. Specifically, each of FIGS. 9A-9C show three different component arrangements of a light source 40 that results in formation of a low beam pattern, a high beam pattern, and a fog beam pattern, respectively. FIGS. 9D-9I show the resulting light patters from the arrangement of components shown in FIGS. 9A-9C.

Figure 9D:
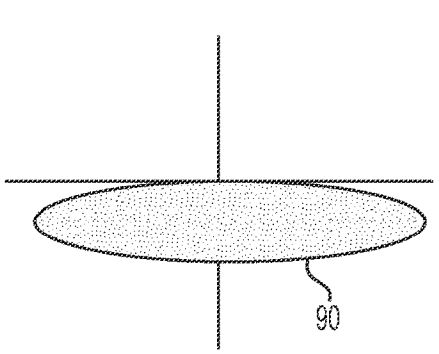
FIG. 9D is a front view of a low beam light pattern that results from the arrangement shown in FIG. 9A, according to the disclosed embodiments.

FIG. 9A is a top, plan view of the base 58 of the parabolic reflector 50 with respect to the light source 40 and the common focus 60. FIG. 9A shows the light source 40 installed at a center position relative to the common focus 60. Because the light source 40 in FIG. 9A is installed at the center of the common focus 60, the bi-optic headlight 20 will form a low beam light pattern, as shown in FIG. 9D. Specifically, the combination of the parabolic reflector 50 and the lens 30 together form the low beam light pattern.

FIG. 9D shows the low beam light pattern 90 that results from the light source 40 being installed in the first position as shown in FIG. 9A. Note that FIG. 9D shows the low beam pattern 90 relative to horizontal and vertical axes. The horizontal axis represents the horizon that a driver of a semi-trailer truck 10 would see off into the distance while behind the wheel of the semi-trailer truck 10. As shown in FIG. 9D, the low beam pattern 90 is oval shaped and located below the horizontal axis, and does not cross over the horizontal axis. Otherwise, the low beam pattern 90 would blind, e.g. oncoming traffic.

Figure 9E:
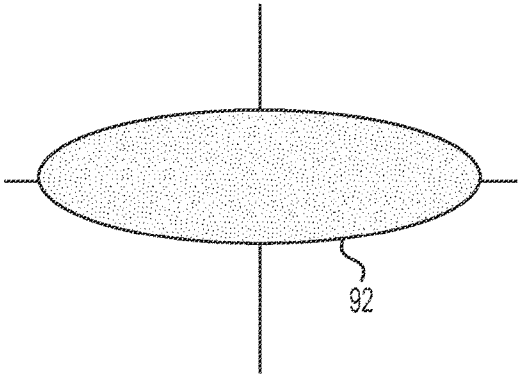
FIG. 9E is a front view of a high beam light pattern that results from the arrangement shown in FIG. 9B, according to the disclosed embodiments.
Figure 9F:
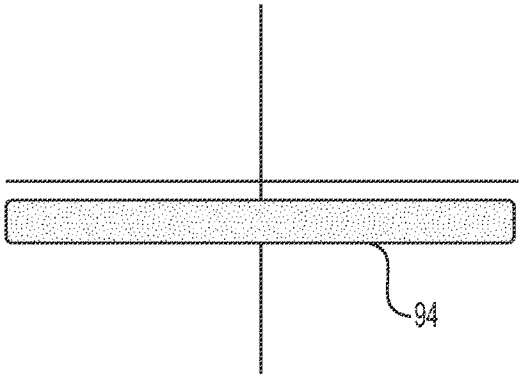
FIG. 9F is a front view of a fog beam light pattern that results from the arrangement shown in FIG. 9C, according to the disclosed embodiments.
Figure 9G:
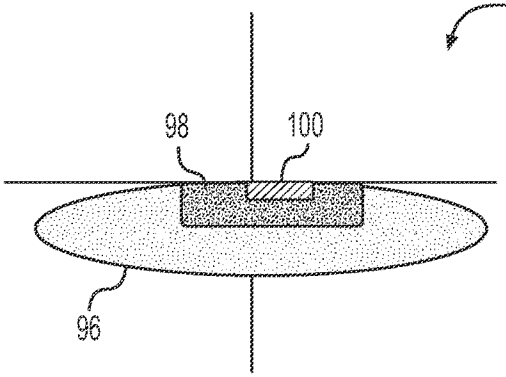
FIG. 9G is a front view of a low beam light pattern that includes the detailed portions of the light pattern shown in FIG. 9D and as a result of the arrangement shown in FIG. 9A, according to the disclosed embodiments.

FIG. 9G shows the three portions of a light pattern. First, the light beam pattern includes a spread light portion 96. The spread light portion 96 is the largest portion of the light pattern. The lens 30 forms the spread light portion 96 of the light pattern. Second, the light beam pattern includes a hot spot 100 located near the upper center of the light pattern. The hot spot 100 is the highest intensity (or concentration) of light. The hot spot 100 is also the smallest and sharpest portion of the light pattern. As mentioned above, larger optical components form smaller, sharper portions of a light pattern. Thus, the parabolic reflector 50 forms the hot spot 100, and the lens forms the spread light portion 96.

Third, the light beam pattern may include a blend light portion 98 that separates the hot spot 100 from the spread light portion 96. However, the blend light portion 98 may not always be included in all light patterns, such as in the fog beam pattern 94, discussed in detail below. Like the hot spot 100, the parabolic reflector 50 also forms the blend light portion 98. The blend light portion 98, when included, is a medium intensity (or concentration) of light, relative to the hot spot 100 and the spread light portion 96, which are greater and lesser intensity, respectively.

As mentioned above, the light source 40 may be fixed to at least two different locations in order to form a high beam pattern and a fog beam pattern.

For example, FIG. 9B is a top, plan view that shows the light source 40 installed at a second position relative to the common focal point 60 on the bottom 58 of the parabolic reflector 50. As shown in FIG. 9B, the second position of the light source 40 is located below the first, center position of the light source 40 as compared to FIG. 9A. The second position results in a high beam pattern 92, as shown in FIG. 9E. FIG. 9E shows that the light pattern is located farther upwards toward, and past, the horizon as compared to the low beam pattern 90 shown in FIG. 9D.

Figure 9H:
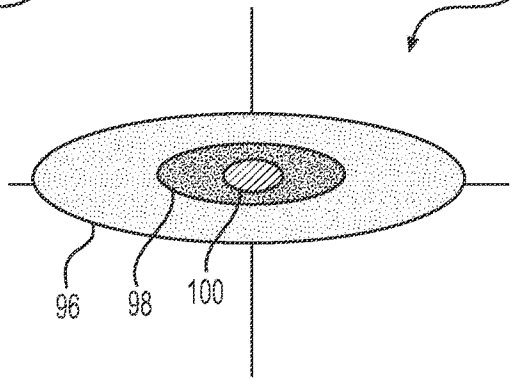
FIG. 9H is a front view of a high beam light pattern that includes the detailed portions of the light pattern shown in FIG. 9E and as a result of the arrangement shown in FIG. 9B, according to the disclosed embodiments.

The three portions of the high beam pattern 92 are similar to the low beam pattern 90. However, the hot spot 100 of the high beam pattern 92 may be shaped differently than the low beam pattern 90. For example, the hot spot 100 in FIG. 9H is oval shaped and is located at the intersection of the horizontal and vertical axes. The high beam pattern 92 also includes the spread light portion 96, which has also moved above the horizon. The high beam pattern 92 also includes a blend light portion 98. As previously noted, the lens 30 forms the spread light portion 96 and the parabolic reflector 50 forms both the blend light portion 98 and the hot spot 100 in the high beam pattern 92, similar to the low beam pattern 90.

The light source 40 may also be installed at a third position different from the first and second positions. The third position is shown in FIG. 9C. FIG. 9C shows that the third position of the light source 40 is located higher than the first position (e.g., the center position) shown in FIG. 9A and the second position (e.g., the lower position) shown in FIG. 9B. When the light source 40 is installed in the higher, third position, the bi-optic vehicle headlight 20 forms a fog beam pattern 94. Specifically, the lens 30 and parabolic reflector 50 together form the fog beam pattern 94.

FIG. 9F shows the fog beam pattern 94 that results from the third position of the light source 40 shown in FIG. 9C. Notably, the fog beam pattern 94 is located below the horizon. However, unlike the low beam pattern 90, the light of the fog beam pattern 94 is projected into a thinner, tighter area. The fog beam pattern 94 may be rectangularly shaped as shown in FIG. 9F.

Figure 9I:
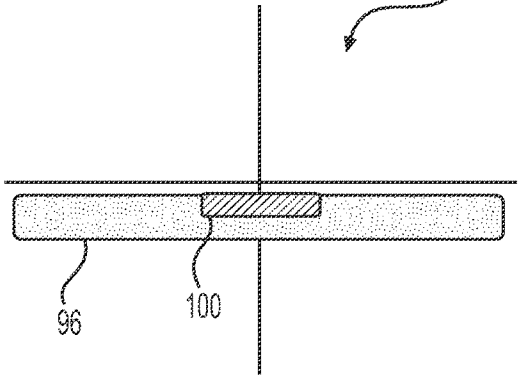
FIG. 9I is a front view of a fog beam light pattern that includes the detailed portions of the light pattern shown in FIG. 9F and as a result of the arrangement shown in FIG. 9C, according to the disclosed embodiments.

The portions of the fog beam pattern 94 can be seen in FIG. 9I. FIG. 9I shows that the fog beam pattern 94 may only include two portions. That is, the fog beam pattern 94 includes the spread light portion 96 and the hot spot 100. However, the fog beam pattern 94 does not include a blend light portion 98, as included in the low beam pattern in FIG. 9G and the high beam pattern in FIG. 9H.

The hot spot portion 100 of the fog beam 94 shown in FIG. 9I is notably wider than the hot spot 100 of the low beam pattern 90 and high beam pattern 92, in comparison of FIG. 9I to FIGS. 9G and 9H.

As with the low beam pattern 90 and the high beam pattern 92, the lens 30 forms the spread light portion 96 of the fog beam pattern 94 and the parabolic reflector 50 forms the hot spot 100 of the fog beam pattern 94.

For each of the above mentioned light patterns, the bi-optic headlight 20 projects about 70% of the emitted light onto the road in front of the driver. Specifically, the lens 30 forms about 35-45% of the light pattern projected onto the road. The parabolic reflector 50 forms about 25-35% of the light pattern projected onto the road. In some embodiments, the lens 30 and the parabolic reflector 50 form about 39% and about 31% of the light pattern on the road, respectively. The remaining percentage may not reach the road.

Schematic Representation of the Bi-Optic Headlight

Figure 10:
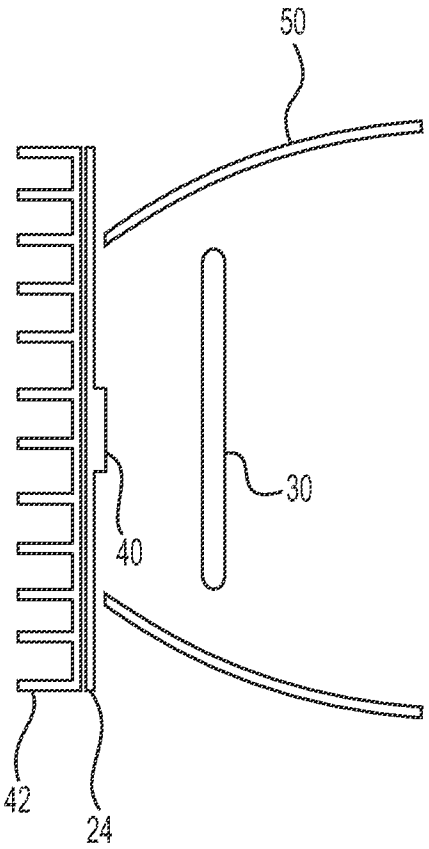
FIG. 10 is a cross-sectional view of the bi-optic headlight and associated components, according to the disclosed embodiments.

FIG. 10 is a cross-section, schematic view of the bi-optic headlight 20. The embodiment shown in FIG. 10 includes a heat sink 42 attached to a circuit board 24. The circuit board 24 and the heat sink 42 are attached to a light source 40, such as an LED. The light source 40 is located inside of the parabolic reflector 50, which is one of the two optical components of the bi-optic headlight 20. The second optical component of the bi-optic headlight 20 is the lens 30. The lens 30 is also located within the outer edge 55 of the parabolic reflector 52 such that the lens 30 directs light from the light source 40 and beyond the outer edge 55 of the parabolic reflector 52.

With this arrangement and configuration, the parabolic reflector 50 and the lens 30 capture different portions of the emission profile of the light source 40. Together, the parabolic reflector 50 and the lens 30 direct light to form one of the three basic light patterns, based on the location of the light source 40 relative to the common focus 50 shared by the parabolic reflector 50 and the lens 30. This synergistically results in the formation of the three basic light patterns with greater efficiency than conventional approaches.

Method of Manufacture

Figure 12:
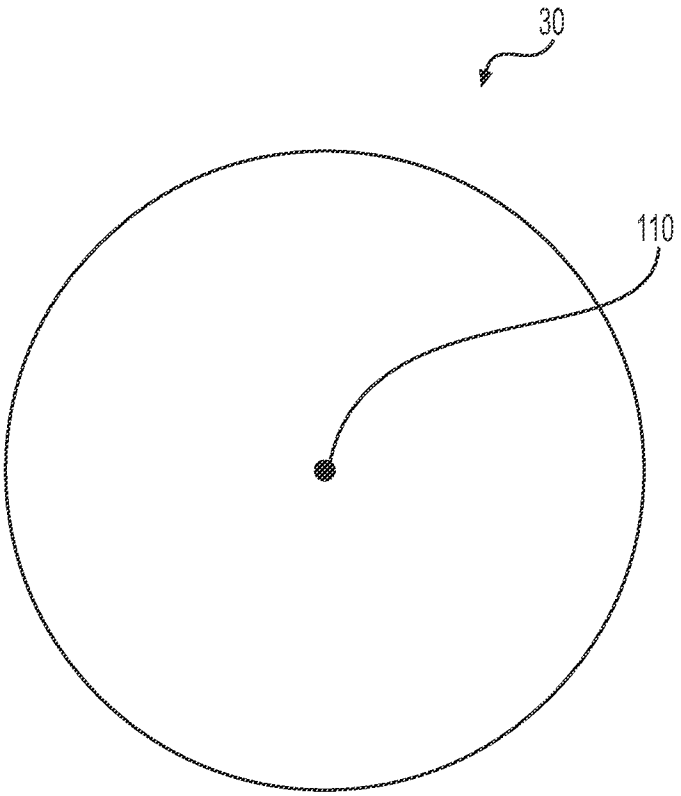
FIG. 12 is a top view of the uncut lens of the bi-optic headlight.
Figure 11:
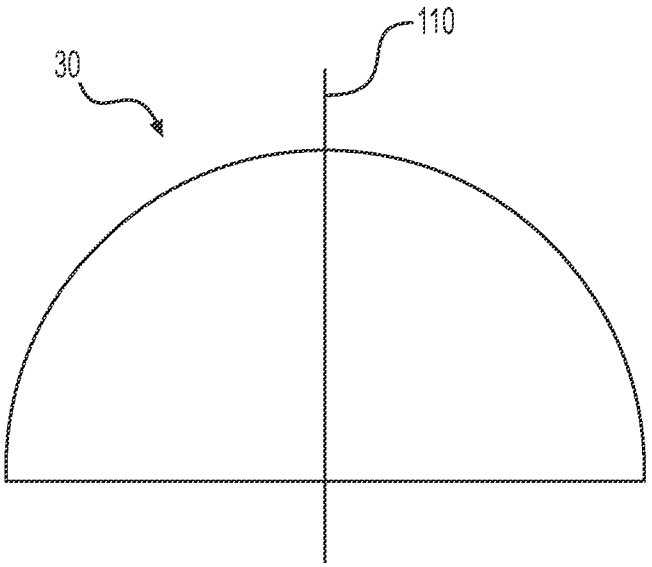
FIG. 11 is a side view of the uncut lens of the bi-optic headlight.

FIG. 11 shows a side view of a lens 30 included in the bi-optic headlight 20. The lens 30 in FIG. 11 is shown prior to cutting the plurality of lens facets 32 with the jagged angular curvatures 38 into the lens 30. Note that although the lens 30 includes a flat bottom in FIG. 11, one skilled in the art would understand that bottom of lens 30 could include a differently shaped surface, such as a round surface. FIG. 11 shows that the lens 30 includes an optical axis 110 that runs through the center of the lens 30. FIG. 12 shows a top view of the lens 30 with the optical axis 110 shown at the center of the lens 30.

Figure 13B:
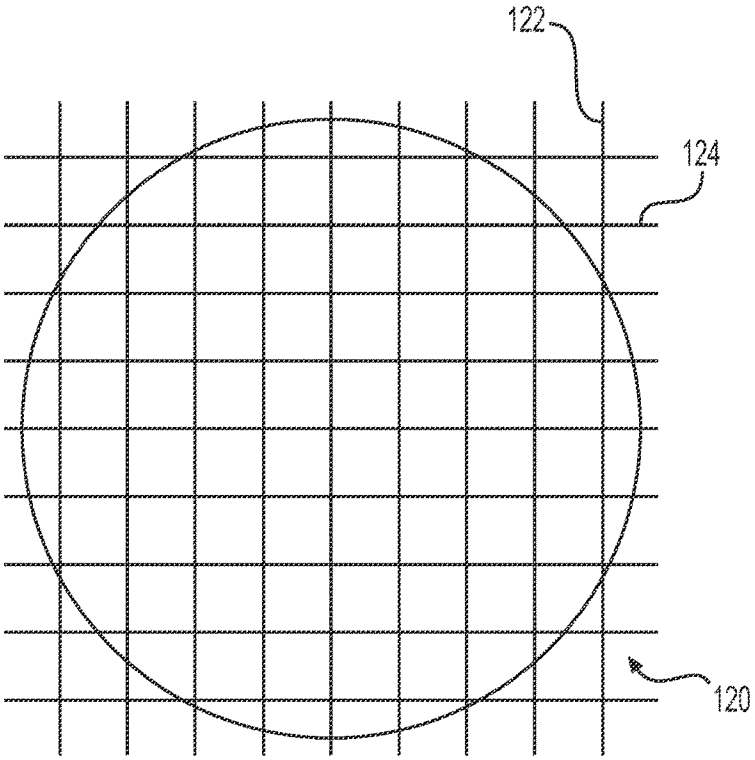
FIG. 13B is a top view that shows various cuts performed on the lens of the bi-optic headlight.
Figure 13A:
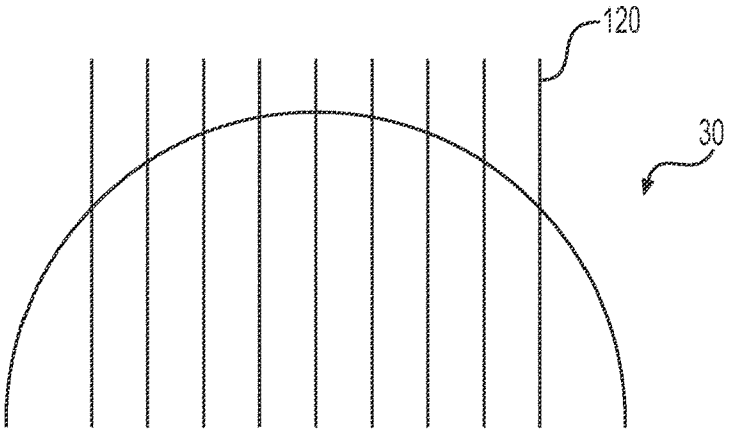
FIG. 13A is a side view that shows various cuts performed on the lens of the bi-optic headlight.
Figure 14B:
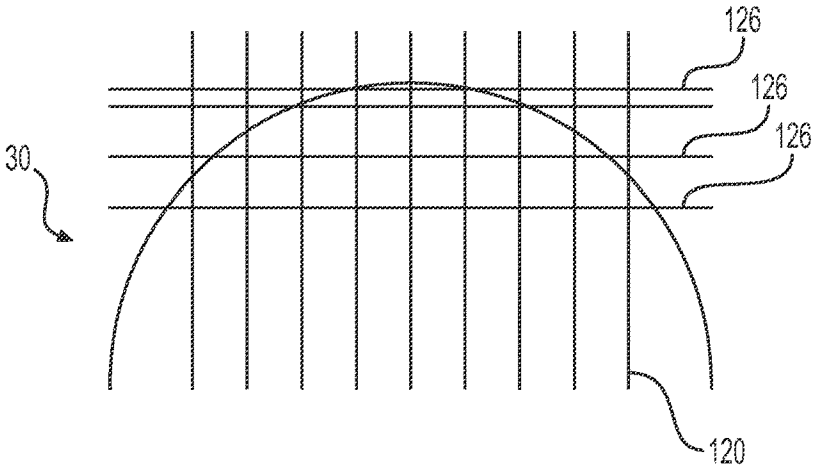
FIG. 14B is a side view that shows additional side cuts performed on the lens of the bi-optic headlight.
Figure 14A:
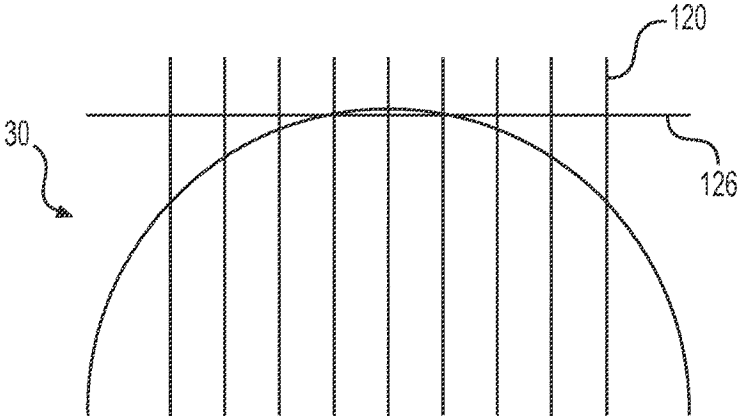
FIG. 14A is a side view that shows an initial side cut performed on the lens of the bi-optic headlight shown in FIGS. 13A and 13B.

FIGS. 13A-15D show an exemplary manufacturing process to produce the lens 30 of the bi-optic headlight 20. The lens 30 is cut with a checkboard cut 120. The checkboard cut 120 extends along the same direction as the optical axis 110, as shown in FIGS. 13A and 13B from the side and top perspective, respectively. The checkerboard cut 120 includes a plurality of vertical cuts 122 and a plurality of horizontal cuts 124 that are arranged substantially perpendicular to the vertical cuts 122.

After the checkerboard cut 120 is formed, a plurality of side cuts 126 are made perpendicular (i.e., orthogonal) to the optical axis 110. The plurality of side cuts 126 can be seen in FIGS. 14A and 14B. Note that the plurality of side cuts 126 intersect with the plurality of vertical cuts 122 and the plurality of horizontal cuts 124 of the checkboard cut 120.

Each of the cuts performed on the lens 30 can be viewed from the perspective of a three-dimensional x-, y-, z-coordinate system. For example, the plurality of vertical cuts 122 span across a y-axis, the plurality of horizontal cuts 124 span across an x-axis, and the plurality of side cuts 126 span across the z-axis with respect to the lens 30.

Although the above description may explain that the checkboard cut 120 occurs prior to the plurality of side cuts 126, the lens 30 of the present disclosure is not limited to this particular sequence. Rather, the noted sequence is used for merely for discussion purposes.

After the plurality of side cuts 126 and the checkboard cut 120, lens sections that are located underneath the outer curved surface of the lens 30 are removed so that the curved outer surfaces of the original lens 30 can be translated down onto a lower level. As the curved surfaces help form the resulting light pattern, this results in a lighter and more compact lens 30.

Figure 15B:
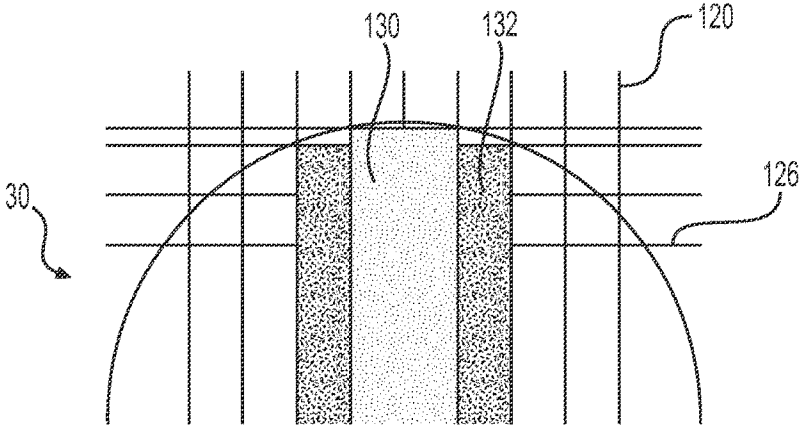
FIG. 15B is a side view that shows the further removal of lens sections from the cut lens of the bi-optic headlight.
Figure 15A:
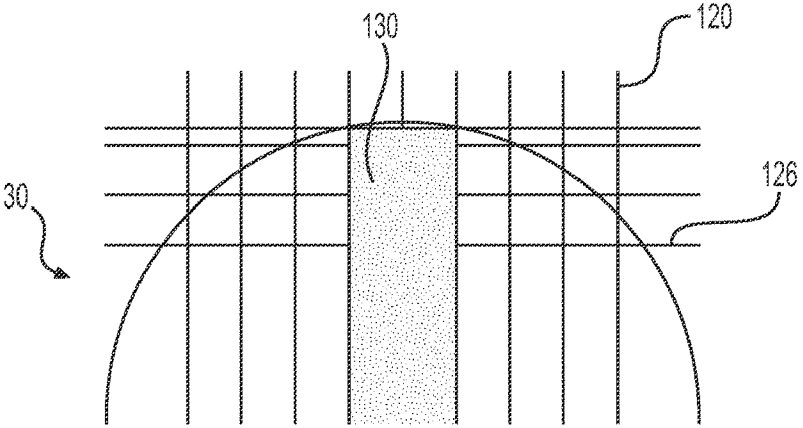
FIG. 15A is a side view that shows the removal of a first lens section from the cut lens of the bi-optic headlight shown in FIG. 14B.
Figure 15D:
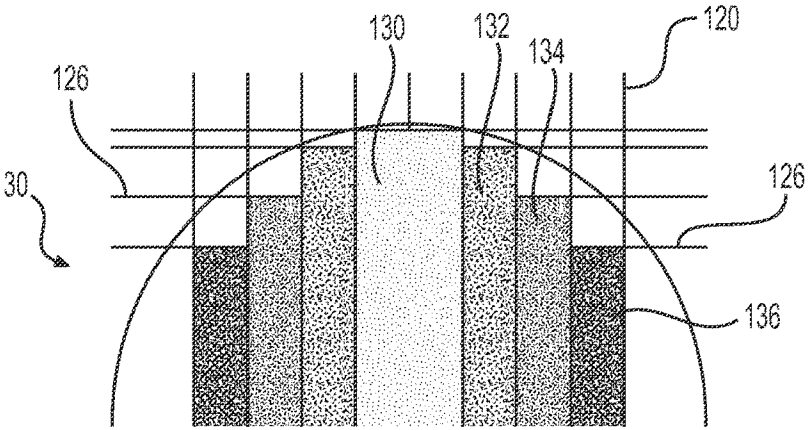
FIG. 15D is a side view that shows the further removal of the lens sections from the cut lens of the bi-optic headlight.
Figure 15C:
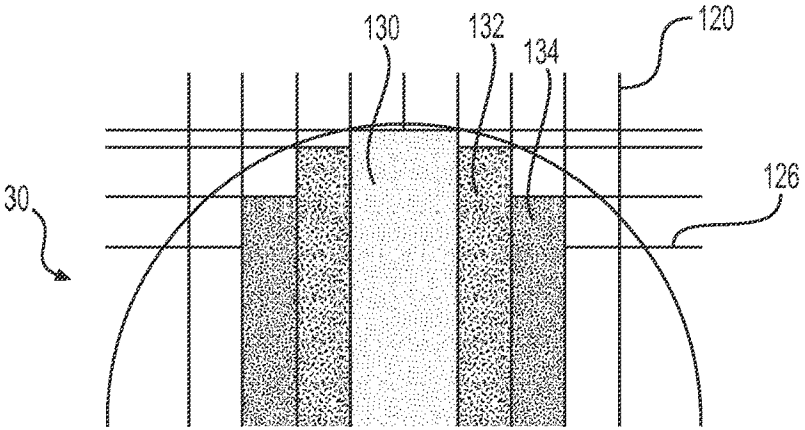
FIG. 15C is a side view that shows the further removal of lens sections from the cut lens of the bi-optic headlight.

Specifically, FIGS. 15A-15D shows the removal of the lens sections from the cut lens 30. FIG. 15A shows the removal of a center lens section 130 from the cut lens 30. FIG. 15B shows the removal of first inner lens sections 132 from the cut lens 30. FIG. 15C shows the removal of second outer lens sections 134 from the cut lens 30. FIG. 15D shows the removal of third outer lens sections 136 from the cut lens 30. Although FIGS. 15A-15D show the plurality of lens sections being removed in a particular sequence, the removal of the plurality of lens sections are not limited to the particular sequence shown in these figures.

Figure 16:
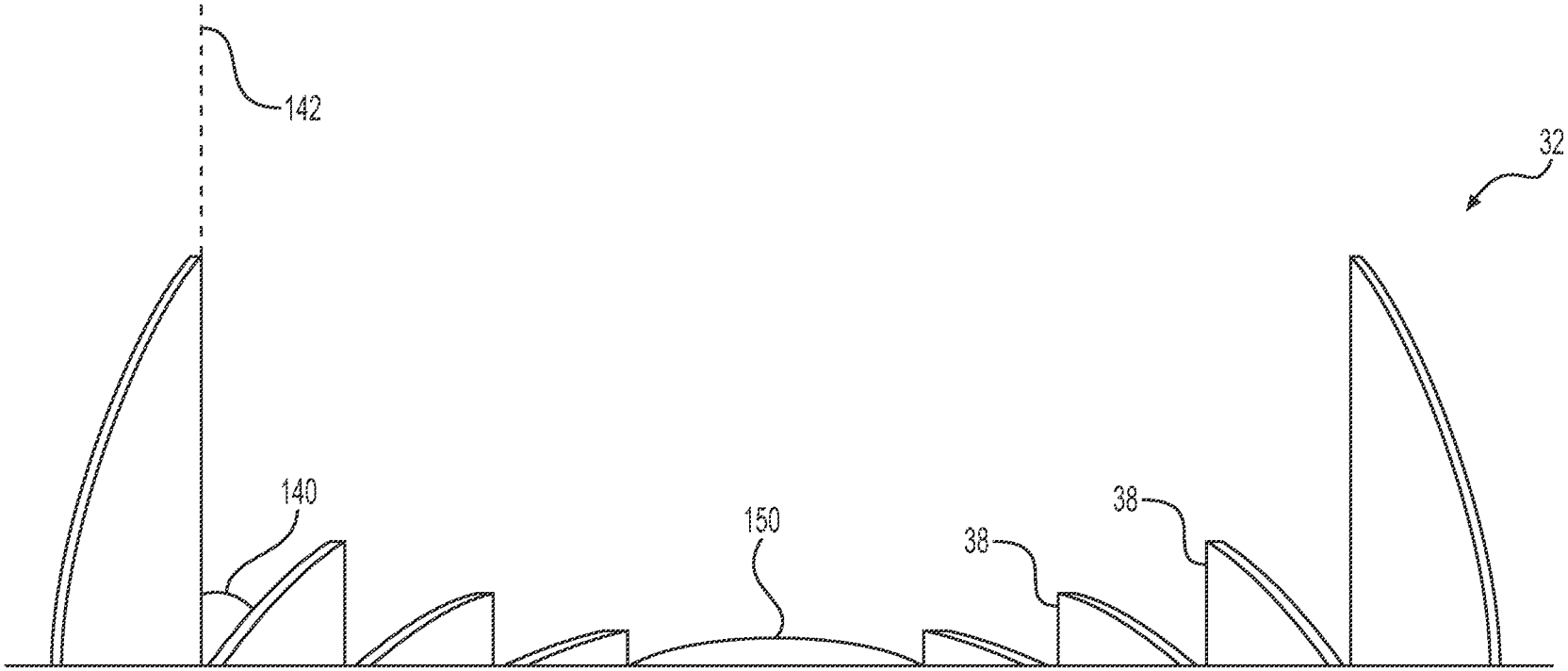
FIG. 16 is an oblique, side view of the plurality of lens facets.

After the plurality of lens sections have been removed, the plurality of lens sections are discarded and the outer curved surfaces are translated downward to result in the plurality of lens facets 32, as shown in FIG. 16. FIG. 16 shows an oblique, side view of the plurality of lens facets 32 of the lens 30. Note that the plurality of lens facets 32 includes a plurality of jagged angular curvatures 38 and a central curved surface 150.

Each of the plurality of jagged angular curvatures 32 includes an interior angle 140 with respect to the vertical direction 142. The respective interior angles 140 increase with respect to the vertical direction 142 corresponding to their proximity to a central curved surface 150 of the plurality of lens facets 32. In other words, the interior angle of the jagged angular curvatures 32 located closest to the central curved surface 150 is greater than an adjacent interior angle located farther away from the central curved surface 150. Since the respective interior angles 140 increase, the curvature of the plurality of jagged angular curvatures 32 increases as well, as shown in FIG. 16.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A vehicle headlight comprising:

a parabolic reflector that includes a flat bottom, a curved sidewall that extends outwardly from the flat bottom to define an outer edge, and a first focal point located on the flat bottom;

a light source that is attached to the flat bottom of the parabolic reflector, that has a front side that faces the outer edge of the parabolic reflector and that emits light toward the outer edge of the parabolic reflector, and a rear side that is opposite to the front side;

a lens that is located between the light source and the outer edge of the parabolic reflector, that is configured to direct light emitted from the light source beyond the outer edge of the parabolic reflector to form a light pattern, that includes a second focal point located on the flat bottom of the parabolic reflector at a same position as the first focal point of the parabolic reflector, that includes an edge sidewall, and that includes a plurality of lens facets that are arranged in a matrix that outwardly extend toward the outer edge of the parabolic reflector; and lens legs that attach the lens to the parabolic reflector, wherein the outer edge of the parabolic reflector and the edge sidewall of the lens are aligned along a diagonal line that intersects the first focal point of the parabolic reflector and the second focal point of the lens, which are both located at the same position.

2. The vehicle headlight according to claim 1, further comprising a circuit board that is attached to the flat bottom of the parabolic reflector and that is electrically connected to the light source, and a heat sink that is attached to the circuit board.

3. The vehicle headlight according to claim 2, further comprising a housing that encloses the parabolic reflector, the light source, the lens, and the heat sink.

4. The vehicle headlight according to claim 1, wherein the flat bottom of the parabolic reflector has a bottom diameter, and the lens has a lens diameter equal to the bottom diameter of the parabolic reflector.

5. The vehicle headlight according to claim 1, wherein the parabolic reflector includes a plurality of reflector facets that are arranged along the curved sidewall of the parabolic reflector.

6. The vehicle headlight according to claim 1, wherein the parabolic reflector includes attachment grooves that mate with the lens legs of the lens and that secure the lens legs to the parabolic reflector.

7. The vehicle headlight according to claim 1, wherein the lens is a cylindrical lens.

8. The vehicle headlight according to claim 1, wherein the lens includes a circular main body that has a center, each of the plurality of lens facets has a jagged angular curvature, and the respective jagged angular curvatures of the plurality of lens facets increases as a lens facet distance from the center of the lens decreases and as the lens facet distance from the curved sidewall of the parabolic reflector increases.

9. The vehicle headlight according to claim 1, wherein
the light source is located at the first focal point of the parabolic reflector and the second focal point of the lens to form a low beam light pattern.

10. The vehicle headlight according to claim 1, wherein the light source is located at a first position on the flat bottom the parabolic reflector that is different than the first focal point and the second focal point to form a high beam light pattern.

11. The vehicle headlight according to claim 1, wherein the light source is located at a second position on the flat bottom the parabolic reflector that is different than the first focal point and the second focal point to form a fog light pattern.

12. The vehicle headlight according to claim 1, wherein
the parabolic reflector defines a parabola that includes a latus rectum that extends across the parabola and a focus located on the latus rectum,
the flat bottom of the parabolic reflector is attached to the curved sidewall of the parabolic reflector at a third position that corresponds to the latus rectum of the parabola, and
the first focal point of the parabolic reflector is located at a fourth position that corresponds to the focus of the parabola, which is located on the latus rectum.

13. The vehicle headlight according to claim 4, wherein
the parabolic reflector defines a parabola that includes a latus rectum that extends across the parabola and a focus located on the latus rectum,
the flat bottom of the parabolic reflector is attached to the curved sidewall of the parabolic reflector at a third position that corresponds to the latus rectum of the parabola, and
the first focal point of the parabolic reflector is located at a fourth position that corresponds to the focus of the parabola, which is located on the latus rectum.

14. The vehicle headlight according to claim 1, wherein
the lens is configured to capture the light emitted from the light source in a first range of about 55-65%, and to form a spread light portion of the light pattern, and
the parabolic reflector is configured to capture the light emitted from the light source in a second range of about 35-45%, which is uncaptured by the lens, and to form a blended light portion and a hot spot portion of the light pattern.

15. The vehicle headlight according to claim 1, wherein
the lens is configured to capture a first amount of the light emitted from the light source, and to form a spread light portion of the light pattern, and
the parabolic reflector is configured to capture a second amount of the light emitted from the light source, which is uncaptured by the lens, and to form a blended light portion and a hot spot portion of the light pattern.

16. The vehicle headlight according to claim 15, wherein
the lens is configured to capture the first amount of light from a center spatial part of the light emitted from the light source, and
the parabolic reflector is configured to capture the second amount of light from an outer spatial part of the light emitted from the light source.

17. The vehicle headlight according to claim 15, wherein
the first amount of light is about 54% of the light emitted from the light source, and
the second amount of light is about 46% of the light emitted from the light source.

18. The lens according to claim 1, wherein
the plurality of facets are arranged in rows and columns, and
the plurality of facets includes a center column that is rounded and that extends outwardly from the first surface of the circular lens main body.

19. A method for manufacturing a vehicle headlight comprising:
providing a lens that has a curved surface, a bottom surface opposite to the curved surface, an edge sidewall that connects the curved surface to the bottom surface, and a center located on a longitudinal axis of the lens;
slicing the curved surface of the lens into a plurality of columns in which a depth of each of the plurality of columns extends to the edge sidewall of the lens;
slicing the curved surface of the lens into a plurality of rows in a direction perpendicular to the plurality of columns to form a plurality of lens facets arranged in a matrix;
slicing the curved surface of the lens in a directional orthogonal to the matrix;
forming each of the plurality of lens facets with a jagged angular curvature such that the respective jagged angular curvatures of the plurality of lens facets increases as a lens facet distance from the center of the lens decreases and as the lens facet distance from an edge sidewall of a parabolic reflector increases, and such that the respective jagged angular curvatures of the plurality of lens facets point to the center of cylindrical lens; and
attaching the lens to the parabolic reflector such that an outer edge of the parabolic reflector and the edge sidewall of the lens are aligned along a diagonal line that intersects a first focal point of the parabolic reflector and a second focal point of the lens, which are both located at the same position.

20. A vehicle headlight comprising:
a parabolic reflector that includes a flat bottom, a curved sidewall that extends outwardly from the flat bottom to define an outer edge, and a first focal point located on the flat bottom;
a light source that is attached to the flat bottom of the parabolic reflector, that has a front side that faces the outer edge of the parabolic reflector and that emits light toward the outer edge of the parabolic reflector, and a rear side that is opposite to the front side;
a lens that is located between the light source and the outer edge of the parabolic reflector, that is configured to direct light emitted from the light source beyond the outer edge of the parabolic reflector to form a light pattern, that includes a second focal point located on the flat bottom of the parabolic reflector at a same position as the first focal point of the parabolic reflector, and that includes a plurality of lens facets that are arranged in a matrix that outwardly extend toward the outer edge of the parabolic reflector; and
lens legs that attach the lens to the parabolic reflector, wherein
the lens is configured to capture the light emitted from the light source in a first range of about 55-65%, and to form a spread light portion of the light pattern, and
the parabolic reflector is configured to capture the light emitted from the light source in a second range of about 35-45%, which is uncaptured by the lens, and to form a blended light portion and a hot spot portion of the light pattern.

* * * * *